US005364080A

United States Patent [19]

Kraemer et al.

[11] Patent Number: 5,364,080

[45] Date of Patent: Nov. 15, 1994

[54] HIGH EFFICIENT HEAT TREATING AND DRYING APPARATUS AND METHOD

[75] Inventors: William E. Kraemer, Sterling Heights; Manouchehr Daneshvar, Novi, both of Mich.

[73] Assignee: Combustion Concepts, Inc., Detroit, Mich.

[21] Appl. No.: 83,196

[22] Filed: Jun. 24, 1993

Related U.S. Application Data

[63] Continuation of Ser. No. 777,018, Oct. 16, 1991, abandoned.

[51] Int. Cl.[5] ..... C21D 1/00

[52] U.S. Cl. ..... 266/262; 266/249

[58] Field of Search ..... 432/8, 136, 147, 175, 432/192; 266/111, 249, 262

[56] References Cited

U.S. PATENT DOCUMENTS

| | | | |
|---|---|---|---|
| 2,289,719 | 7/1942 | Moran | 266/261 |
| 3,055,652 | 9/1962 | Remmey et al. | 266/261 |
| 4,154,861 | 5/1979 | Smith | 426/466 |
| 4,202,661 | 5/1980 | Lazaridis et al. | 432/8 |
| 4,313,772 | 2/1982 | Paulus | 148/142 |
| 4,373,702 | 2/1983 | Jayaraman et al. | 266/111 |
| 4,438,572 | 3/1984 | Kaminski | 34/218 |
| 4,462,383 | 7/1984 | Henke et al. | 126/21 A |
| 4,597,734 | 7/1986 | McCausland et al. | 431/328 |
| 4,622,946 | 11/1986 | Hurley et al. | 126/39 E |
| 4,701,340 | 10/1987 | Bratton et al. | 426/511 |
| 4,810,587 | 3/1989 | Losfeld et al. | 428/549 |

OTHER PUBLICATIONS

"Bekaert Fiber Technologies," pp. 1355–1363, Thomas Register Catalog File, Dec. 1991 directed to a description of fiber metallic sheet materials.

"Metallic Fibre Surface-Combustion Radiant Gas Burners," a paper delivered by Strachan et al. at the Dec. 1989 International Gas Research Conference.

*Primary Examiner*—Scott Kastler

*Attorney, Agent, or Firm*—Harness, Dickey & Pierce

[57] ABSTRACT

A zone controlled furnace for heat-treating of metallic and non-metallic stocks positions one or more modular metallic combustion burners in the furnace chamber and along the path of the stock to selectively control the heat supplied to any zone of the furnace chamber. The burners receive and ignite a high pressure premix of combustible gas and are illustrated by a porous fiber metallic sheet and a jet burner arrangement which discharge flames direct, and a jet nozzle which discharges heated combusted products. The high pressure/-velocity flame and products of combustion ejecting from the burners will impinge on the workpieces and generate a very high convective heat transfer rate in a turbulent flow, as well as radiant heat, thereby resulting in uniform heating of non-uniform shaped pieces and maximizing overall heat transfer in the furnace. The apparatus can be controlled to act in a heating mode, or in only a cooling mode, or a combination of modes in any zone for precise temperature control.

32 Claims, 6 Drawing Sheets

ZONE2
60
ZONE3
60
ZONE4
60
122
3
ZONE1
60
76
4
76
78
76
78
60
ZONE8
60
ZONE7
60
ZONE5
60
ZONE6
3
4

68
74
75
78
72
80
50
62
24
70
50
68
78
24
62
72

28
24
50
64
72
24
50
75
72
72
62
66
64
74
78
80
66
74
78
78
78
76
74

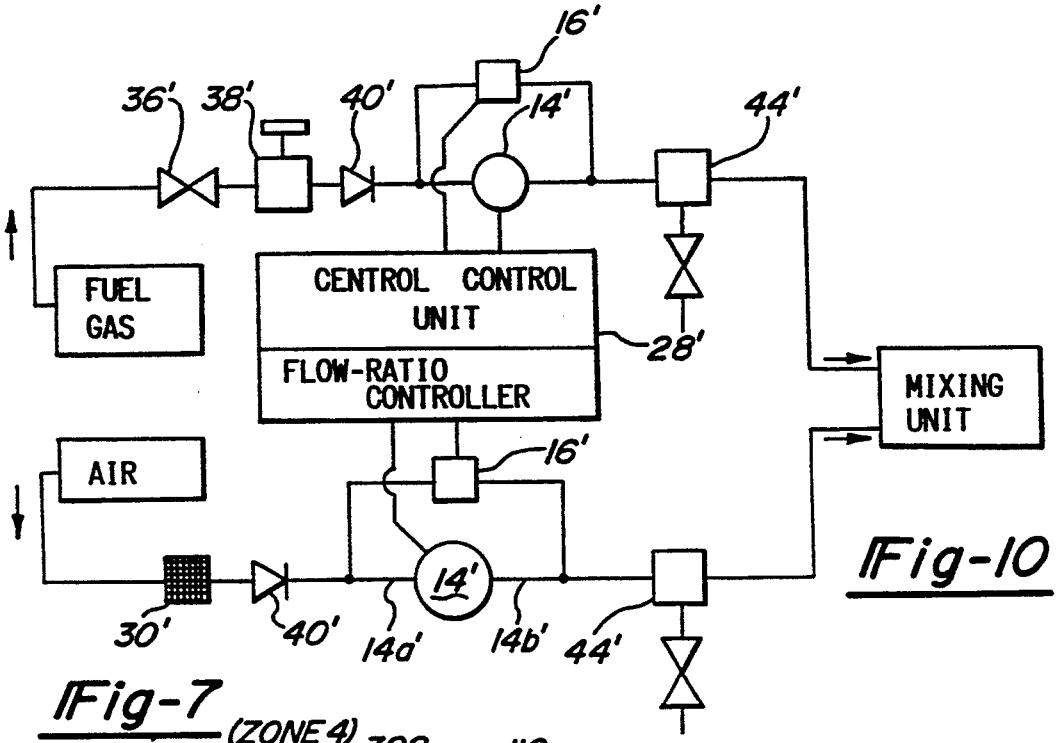
Fig-10
Fig-7
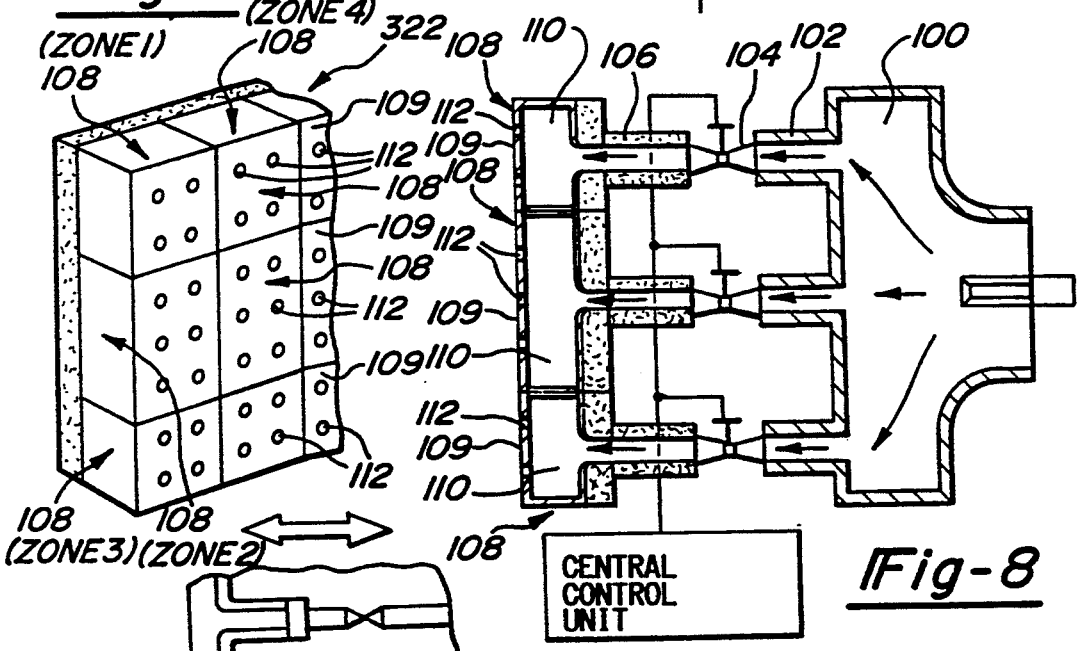
Fig-8
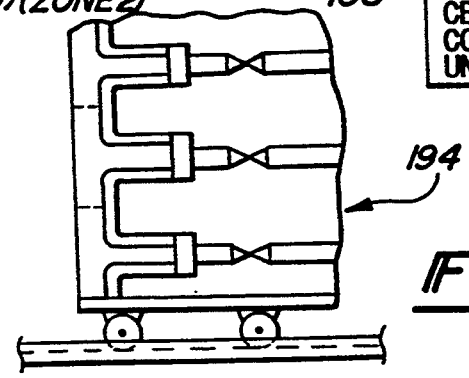
Fig-9

HIGH EFFICIENT HEAT TREATING AND DRYING APPARATUS AND METHOD

This is a continuation of U.S. patent application Ser. No. 07/777,018, filed Oct. 16, 1991, now abandoned.

BACKGROUND AND SUMMARY OF THE INVENTION

This invention relates to the heat treating of metallic and non-metallic stocks in the form of strip, sheets, shapes and slabs, in both a continuous and batch type furnace, and more particularly to applying jet impingement technology and methods for heat treating stock.

The heat treating operation has drawn considerable attention over the last decade as higher energy cost, energy availability, operating cost, product quality and emission levels have come to bear. The need for high efficiency furnaces has resulted in efforts directed to achieve new levels of efficiency. Some of these efforts are reflected in Lazaridis et al. U.S. Pat. No. 4,202,661 entitled "Jet Implement Radiation Furnace, Method and Apparatus" which issued May 14, 1980 and Jayaraman et al. U.S. Pat. No. 4,373,702 entitled "Jet Impingement/Radiant Heating Apparatus" which issued Feb. 15, 1983.

The issues mentioned above have created a market need for high efficiency, less polluting furnaces. Though a considerable amount of effort and progress has been made, a new level of efficiency, temperature uniformity and emissions are necessary if industry is to continue to be competitive within the world market. This invention addresses the issues of higher efficiency, improved temperature uniformity and reduced pollutants.

Many existing industrial heat treating operations are productivity limited due to space constraints, quality requirements and temperature requirements. This invention offers an alternative solution to those limitations.

The newest heat treating furnaces are usually a continuous design where the stock is heated as it moves through the furnace. These furnaces incorporate convection heating, radiation heating or a combination of both. These furnaces are directed toward increasing energy efficiency. Likewise, many heat treating furnaces use various forms of jet impingement to increase the convective heat transfer rate and thereby improve efficiency within the furnace.

Many of the continuous heat treating furnaces using jet impingement require that the impinging source be in very close proximity to the workpiece in order to take advantage of the higher heat transfer rate. Likewise, this close proximity to the work makes maintenance more difficult and creates the opportunity for the stock to damage the furnace and its component parts as it travels through the furnace. Likewise, stoppage and/or slowdowns can result in loss of material due to poor quality resulting from non-uniformheating and/or not meeting energy rate requirements.

A primary object of this invention is to provide a zone controlled heat treating furnace that has high efficiency and produces less pollution by increasing the rate of the combustion reaction and by substantially increasing the convective heat transfer rate within the heat treating furnace.

A further object of this invention is to provide a heat treating and drying apparatus operable in either a heating and/or a cooling mode and having a control system to continuously monitor and select a mode whereby to precisely control the heating and cooling rates in these modes for improving product quality.

Another object of this invention is to provide a high pressure, high velocity, reacting mixture such that the distance to the workpiece is not critical. The high velocity/pressurized atmosphere also provides the ability to recover residual heat through a secondary heat exchanger and/or to remove unwanted substances from the flue exhaust.

Another object of this invention is to provide a plurality of like furnace burner modules which may be operatively connected in parallel to allow flexibility in design such that a wide variety of heat treating applications can benefit from the advantages of this process.

Another object of this invention is to provide a furnace having an elongated super atmospheric heating chamber through which workpieces are passed and which has a heat radiating surface encircling the path and through which high pressure/velocity flame or products of combustion will pass to impinge on the workpieces to generate a high convective heat transfer in a turbulent flow.

Yet another object of this invention is provision of a furnace to heat stock rapidly and provide uniform heating of the stock, even when the stock is of a complex shape. The high pressure/velocity and the high convective heat transfer rates coupled with a heating and/or cooling mode along with the flexibility to pattern and design the burner/jet nozzles based on the shape/configuration of the stock enables this system to meet this objective.

Still another object is to provide both a high convective heat transfer rate and a high radiation heating rate within the furnace environment and thereby maximize overall heat transfer within the furnace and reduce the cost to heat treat the stocks.

Yet another object of this invention is provision of a high pressure velocity combustion process to increase the rate of chemical reaction and reduce the rate of $NO_x$ formation over conventional burners.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings, wherein:

FIG. 7 is an elevation view of an alternate embodiment of a zone controlled burner assembly for use in the furnace of FIG. 1, the burner assembly being shown as a jet nozzle system.

FIG. 8 is an elevation section view of the jet nozzle system of FIG. 7.

FIG. 9 is a view of a trolley system useful in moving the burner assembly relative to the furnace chamber.

FIG. 10 is a schematic flow diagram of an alternate embodiment of a system for supplying fuel gas and air to the burner system and a compression system therefore using multiple compressors.

DETAILED DESCRIPTION OF THE PREFERRED EMBODIMENT

Figure 1:
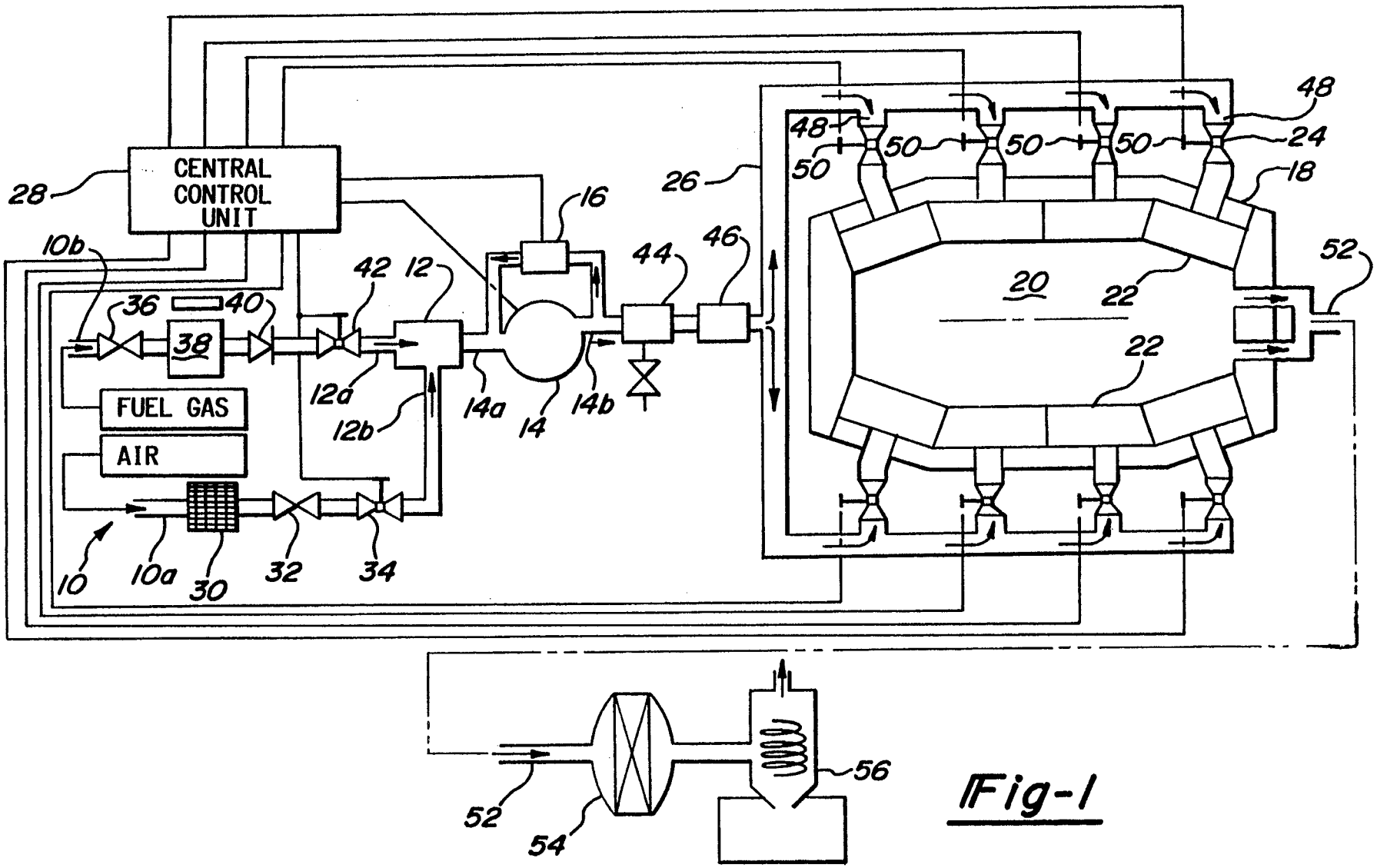
FIG. 1 is a schematic flow diagram of a high pressure heat treating furnace according to the present invention and embodying a zone controlled burner assembly.

Referring now to the drawings, FIG. 1 is a schematic flow diagram of apparatus for heat treating and drying metallic and non-metallic stocks in a continuous or batch-type operation. In particular, the apparatus is shown as a furnace having a zone controlled chamber defined by the unique burner systems shown in the preferred embodiments of FIGS. 2–4, or FIGS. 5–6, or FIGS. 7–8. As will become apparent from the following discussion this particular design and the additional designs presented do not encompass the entire spectrum of designs that can use the principles of this invention.

FIG. 1 shows an exemplary heat treating apparatus according to this invention, which apparatus includes a fuel gas supply system 10 for supplying fuel gas at **10*b* and a complementary air supply system for supplying air at 10*a*; a mixing unit 12 for receiving and mixing the air and fuel gas to form a combustible premix; a compressor 14 for pressurizing the premix and having an inlet 14*a* and outlet 14*b*; a bypass/delivery system 16 for recirculating the premix between the outlet and inlet ends of the compressor; a furnace 18 having an elongated chamber 20 in which workpieces are heated; a burner assembly 22 in the chamber and having one or more inlets 24 for receiving the combustible gas mixture; a gas distribution system 26 for passing the combustible gas mixture from the compressor outlet 14*b* to the gas inlets 24; and a central control unit 28** which ensures that a correct volume and desired mixture of gas is supplied to the gas premix system. Relative to FIG. 1, the stock or workpieces are moved in a direction perpendicular to the plane of the paper and between opposite ends (not shown) of the furnace. The apparatus for moving the stock is not shown as being understood by one skilled in the art.

Air is supplied to the system through an air filter 30 and can comprise preheated air, fresh air, or any combination of the two. The size and type of the filter will depend on parameters such as the capacity of the furnace and the compressor requirements. The air filter will remove unwanted dust and other contaminating particles from the air stream and thereby protect the mixing unit, the compressor system, and the burner assemblies. A manually operated isolating valve 32 provides a means of turning off the air supply in the event of maintenance and/or emergency shut down. A control valve 34 is activated through the central control unit and controls the volumetric supply of filtered air to the system. The combustion process will terminate without air. Isolating valve 32 is a secondary safety valve, as control valve 34 would normally turn the air supply off.

Fuel gas is supplied to the system from a direct piped supply, such as from a natural gas distribution company, or from storage tanks. Preferably, the fuel gas would be natural gas but it could be any suitable fuel gas, such as propane. A manually operated isolating valve 36 provides a means of cutting off the supply of gaseous fuel to the remainder of the system. A governor 38 controls the volumetric flow and pressure of fuel gas to ensure the correct predetermined ratio of air and fuel gas is being supplied to the mixing unit 12. A check valve 40 is provided as a safety device to allow the flow of fuel gas in one direction only. As this is a pressurized system, a failure or loss of pressure will close the check valve and stop the flow of fuel gas and thereby terminate the combustion process. A control valve 42 is in series with the governor 38 and the central control unit 28 to provide the proper volumetric supply of fuel gas to the system. The governor 38 is in series with the air and fuel control valves 34 and 42 and controls the flow of gas as a function of the systems pressure and energy requirements. Isolating valve 36 is a tertiary safety valve as the control valve 42 and/or the check valve 40 should shut off the supply of gaseous fuel should an abnormal situation arise.

Mixing unit 12 has a pair of inlet orifices **12*a* and 12*b*, respectively, to receive the fuel gas and air, mixes the two gases to form a combustible gas mixture, and presents the gas mixture to the demand or input side 14*a* of compressor 14**. The combination of the suction from the compressor and the design of the mixing unit orifices results in a thorough mixing of the air and fuel gas.

The compressor 14 increases the pressure of the combustible premix to provide combustible gas to the burners at super atmospheric levels. Preferably and in accordance with this invention, this pressure would be between one and fifteen psig. The size and type of the compressor will be determined by the demand and/or capacity needs of the particular heat treating furnace/application.

The bypass/delivery system 16 is comprised of a pressure sensitive governor which is used to control the firing rate of the furnace when the furnace is operating in its various modes, to be described herein. The pressure-sensitive governor is controlled by the central control unit 28 and determines the amount of premixed gas mixture that is recirculated to satisfy the furnace requirements. This provides flexibility to the unit and greatly enhances the turndown characteristic of the furnace. Likewise this pressure-sensitive governor assures that a continuous non-pulsating flow of pressurized fuel gas/air mixture is supplied to the burner system.

An oil trap 44 or coalescing filter to remove the oil from the combustion mixture is provided between outlet **14*b* of compressor 14 and the gas distribution system 26**.

A flame trap 46 is positioned between the bypass delivery system 16 and the distribution subsystem 26 as a safety consideration to ensure that upon loss of pressure or a reduction in premix flow velocity, the combustion mixture will not create a flash back (i.e., back burning through the system). The flame trap is provided to stop the propagation of a backward flame from the burner that could damage the equipment.

The distribution subsystem 26 for the pressurized high velocity premix gases includes distribution manifolds 48, the flow through which is regulated by control valves 50. The premix combustion gases then flow directly from the manifolds 48 into the gas inlets 24 of the combustion burner assemblies 22.

The filters, governor, isolation valves, control valves, check valve and orifices are all commercially available items and form no part of this invention. The compressor, oil trap and pressure governor are commercially available items and form no part of this invention.

Preferably and in accordance with this invention, the combustion burners assemblies 22 are constructed to form predetermined zones and the control unit 28 operates on control valves 50 to distribute the premix into one or all of the predetermined zones, as desired. A zone type system enables the furnace to operate in a very high efficiency manner because only a required burner zone will operate depending on the specific size and volume of workstock. The flow of the premix combustion gases into any specific zone is controlled by the control valve 50 associated with each zone, each zone control valve being controlled by the central control unit 28. This manifold system in combination with the super atmospheric feature of the system enables the heating to be on the top, bottom, or sides of the workstock and/or any combination thereof. This results in uniform heating of the particular workstock.

Preferably and in accordance with this invention, each burner assembly 22 includes flow/diffusion elements, and an ignition source for combusting the fuel-/air premix. Each combustion burner operates to receive and ignite the high velocity/pressure gas premix and direct high energy heat radiation onto the workpiece with minimal loss of pressure through the burner. As will be discussed, herein, the combustion burner assembly 22 can comprise a porous fiber metallic surface combustion burner 122, a jet nozzle 222, or a pressurized burner 322 design. Each burner assembly herein will achieve a required flame stability, have the desired pressure drop, and operate under the various operating conditions of this invention.

The furnace is designed in such a way that the super atmospheric condition of the combusted premix is maintained within the furnace chamber. Such a furnace can maximize turbulent hot gas flow over the workstock thereby enhancing the convective heat transfer. Under this condition the flow of the combustion products can be directed towards an exhaust flue 52 which is small in size as compared to conventional exhaust flues. The flue exhaust can be directed in any direction that space and design limitations place on it.

The high velocity flue products exit furnace chamber 20 and go through a heat exchanger/recuperator subsystem 54 and/or a cyclone/fine particle separator 56. The high velocity/pressurized flue gases have residual heat which can be extracted by use of a secondary heat exchanger. If insufficient pressure/velocity exists to effectively move the fuel gases through the secondary heat exchanger, an induced draw motor can be used. The heat exchanger is of a design which requires a low pressure drop. The recovered heat from this unit can be used to preheat the workstock or combustion air and/or for use in some other area.

The cyclone/fine particle separator 56 and/or catalytic converter are commercially available and form no part of this invention. The velocity/pressure of the fuel exhaust gases enables the use of such devices to scrub and/or clean the flue exhaust of unwanted or recoverable particles. Many heat-treating processes involve the use of coating, cleaning and drying agents that may result in undesirable emissions or recoverable materials. This invention addresses this issue with the cyclone/-fine particle separator and/or catalytic converter subsystem.

The fuel gas and air supply systems, the mixing unit 12, the compressor 14, the bypass/delivery subsystem 16, and the furnace 18 are all insulated such that overall energy loss is held to a minimum. Suitable insulating materials will be known to those skilled in the art.

Figures 2, 3, 4:
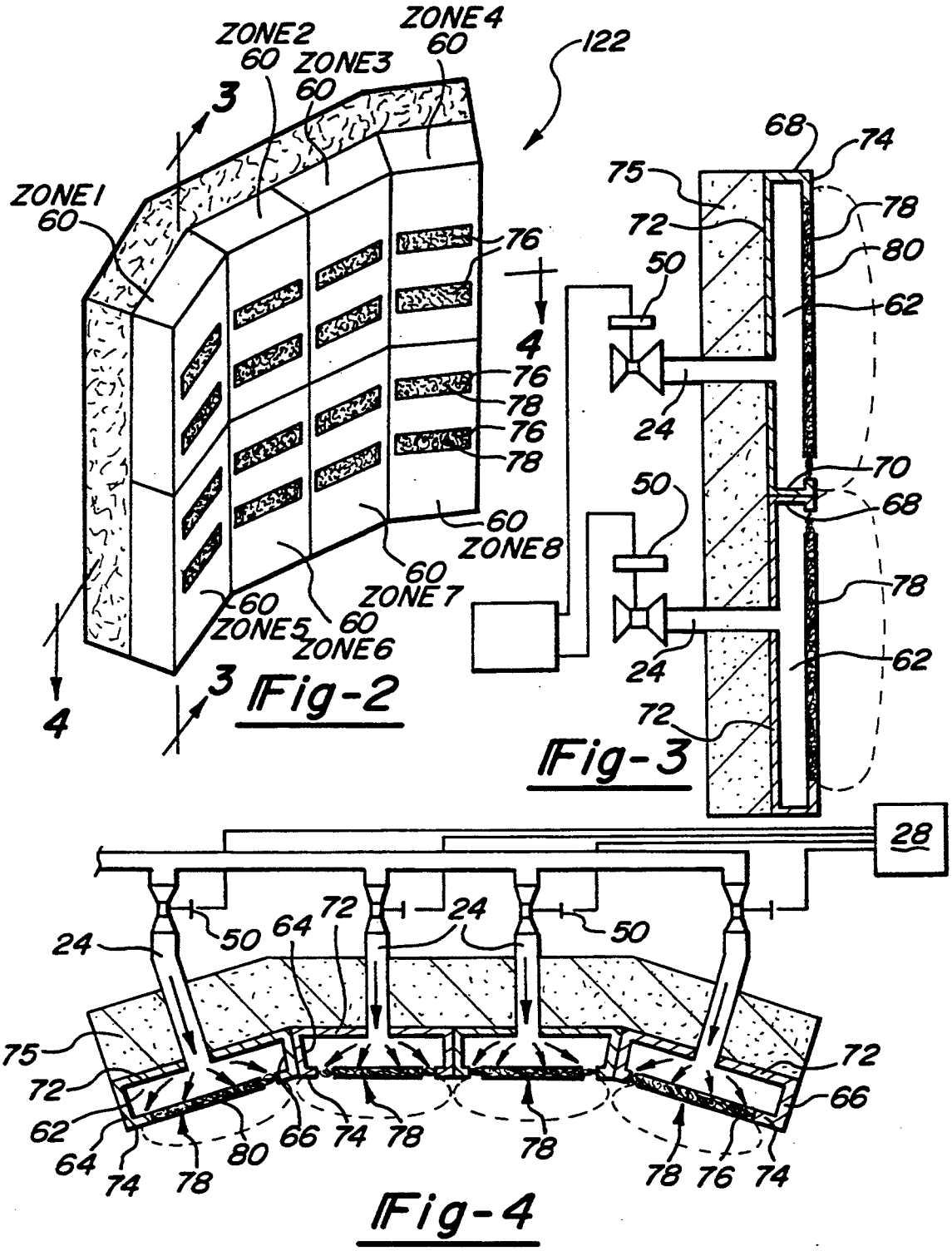
FIG. 2 is an elevation view of an embodiment of a zone controlled burner assembly for use in the furnace of FIG. 1, the burner assembly being shown as a porous fiber surface combustion burner.
FIG. 3 is an elevation section view of the surface combustion burner taken along line 3—3 of FIG. 2.
FIG. 4 is a plan section view of the surface combustion burner taken along line 4—4 of FIG. 2.

In accordance with this invention, FIGS. 2, 3 and 4 are directed to a first preferred embodiment of a burner assembly 22 according to this invention, and is illustrated as a surface combustion burner, designated by the reference number 122. The burner comprises a plurality of like box-like housings 60 formed from an impermeable heat resistant material, such as stainless steel, to forman interior plenum 62, for receiving the mixed air and fuel gas, the housing including four side walls 64, 66, 68 and 70, a rear wall 72 for supporting gas inlet 24, and a front wall 74 defining a burner surface. As shown, eight of the burner housings 60 are assembled together to form a semi-hexagonal wall, representing the burner assembly 122. The burner housings cooperate to form eight zones.

As shown in connection with FIG. 1, a pair of burner assemblies 122 would be placed above and below the path of the workpieces to encircle the workpiece with heat. It is to be understood that the number of burner housings 60 assembled could be different, or the burner assembly could be one piece, or form a semi-cylindrical shape, or form a desired cross-section to achieve the heat treating needs of the furnace and chamber design.

The front wall 74 of each housing 60 includes a pair of generally rectangular-shaped openings 76 that communicate with the plenum. The openings 76 of each housing are generally parallel to one another, and parallel to or aligned with like openings in the next adjacent housing of the assembled semi-hexagonal wall. Preferably, the rows of openings would be about 4–10 inches apart. Each opening 76 is supportingly covered by a planar sheet 78 of porous fiber metallic material that is permeable to gas and faces the workpieces. While not shown, an igniter would be provided proximate the housing front wall 74 to combust the gases on the burner surface. Further, insulation 75 is applied to the manifold and against rear wall 72 of the housings to minimize heat losses.

Each surface combustion burner 78 is preferably formed of a fiber metallic material. Suitable fiber metallic materials include FECRALLOY® a registered trademark of and available from U.K. Atomic Energy Authority, U.K., and BEKIFOR®, BEKINOX®, BEKINOX®, BEKITEX® and BEKITHERM®, all registered trademarks of and available from N.V. Bekaert, S.A., Belgium. Fiber metallic sheet materials are described in "Bekaert Fiber Technologies," pages 1355–1363, Thomas Register Catalog File, 1991, and in "Metallic Fibre Surface-Combustion Radiant Gas Burners," a paper delivered by Strachan et al. at the 1989 International Gas Research Conference.

When ignited, a flame is formed on and emanates from the front surface 80 of the sheet 78 in a uniform fashion towards the workstock. The high velocity/pressure of the super atmospheric burner results in a faster rate of chemical reaction, high velocity flame, higher convective heat transfer coefficient and higher radiation heat transfer than a conventional burner.

The distribution manifold 26 delivers the premix combustion gases through the control valves 50 to the respective inlets 24. This manifold design enables the premix combustion gases to be directed to the various zones within the furnace. Depending on the operating requirements of the furnace the central control unit will actuate, de-actuate and/or modulate the individual zone control valve 50 supplying a given burner housing (i.e., furnace zone).

This design in tandem with the central control unit enables the furnace to efficiently match the energy requirements of the system. For example in a continuous strip heater the width of the workstock can vary from coil to coil. With this invention, only the zones that are required to heat the stock will be fired resulting in higher energy efficiency. This burner/furnace design is insensitive to direction therefore the burners can be of a horizontal or vertical or triangular configuration, adding flexibility to retrofitting and other design constraints. The unique feature of this invention also provide flexibility in handling various shaped workpieces without loss of furnace efficiency.

Further, as desired, the fuel gas could be closed off to the zones. As will be described below, cooling air only could be supplied, as needed, to instantly change the thermal environment and thereby provide operating flexibility.

Figure 5:
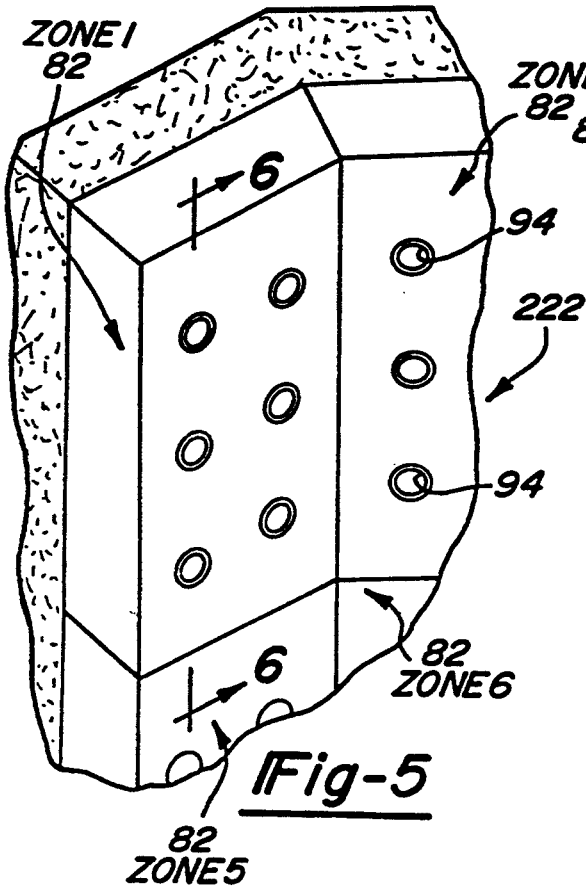
FIG. 5 is an elevation view of an alternate embodiment of a zone controlled burner assembly for use in the furnace of FIG. 1, the burner assembly being shown as a high pressure jet burner.
Figure 6:
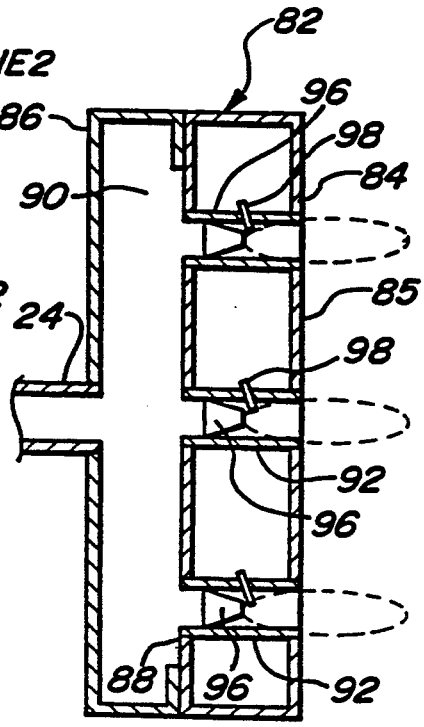
FIG. 6 is an elevation section view of the jet burner taken along line 6—6 of FIG. 5.

FIGS. 5 and 6 are directed to an alternate preferred embodiment of a combustion burner assembly 22 in accordance with this invention and is illustrated as a jet nozzle design, designated by the reference number 222. In accordance with this embodiment, a plurality of like box-like housings 82 are assembled together to form a semi-hexagonal wall in the manner described above. Each housing 82 encloses an interior gas distributing space and includes a front wall 84 to form a front face 85, a rear wall 86 connected to a gas inlet 24, and an interior partition 88 that divides the interior housing space so as to define a plenum 90 adjacent the rear wall 86 to receive the premix. A plurality of cylindrical burners 92 extend between the partition 88 and the front wall 84, each burner having a rear end secured in an opening formed in the partition and a forward end secured in an opening formed in the front wall. Each burner communicates directly with the plenum 90 and provides a discharge opening 94 on the front face 85. A converging jet nozzle 96 and an ignition device, shown as a spark plug 98, are disposed in each burner, the plug being proximate to the front face and forwardly of the nozzle for effecting combustion. The pattern or configuration of the burner openings 94 can be in a regular array, as shown, or diagonal, or staggered, or disposed in random pattern depending on the workstock.

A super atmospheric flame emanates from each opening 94 and is directed towards the workstock. Each burner sits flush on the front face to give stability to the furnace and protect the intricate parts of the burners from damage. The jet flames emanating from these jet burners results in a very fast rate of chemical reaction, very high convective heat transfer coefficient and higher overall radiation within the furnace. These jet burners can also be directionally pointed towards a given spot in the furnace by setting them at an angle to the support surface. This provides better directional control of the flue exhaust and/or the intensity of heat to a given area of the workstock.

As shown, the furnace utilizing the jet burners provide a multizoned heat treating chamber with the burners within any given zone coming on or off and/or modulating, as required by the system. The same manifold, distribution and control valve configuration that was used with the fiber metallic burners can be used to supply and control the premix combustion gases to the jet burners and thereby provide all the same features and advantages as stated in regards to the embodiment of FIGS. 1 to 3.

FIGS. 7 and 8 are directed to still another alternate embodiment of a combustion burner assembly 22 in accordance with this invention and is illustrated by reference number 322. For applications where a direct flame on the workpiece is considered detrimental, super atmospheric products of combustion can be used. Burner assembly 322 includes an insulated combustion chamber 100 wherein gas premix is combusted, a manifold 102, similar to that shown in connection with FIG. 1, which directs the products of combustion to a respective control valve 104, and into a series of conduits 106. Thereafter the products of combustion enter into a respective plurality of box-like housings 108 each forming a chamber 110 and having a front wall 109 provided with an array of gas jet nozzles 112. The nozzles 112 can be disposed in a rectangular grid, as shown, or in any other desired arrangement. As described above, each box-like housing comprises a controllable zone of the furnace. The products of combustion are delivered to the chambers via the conduits 106 and exit through the jet nozzles. These jet nozzles 112 are placed in a diagonal, staggered or random pattern design depending on the workstock.

Advantageously, jet nozzles 112 can be directionally pointed towards a given spot in the furnace chamber to provide greater directional control to the flow of the very high velocity/pressurized gases. The high velocity gases exiting these jet nozzles result in very high convective heat transfer coefficient and low emission levels. The control valve and furnace zone configuration are similar to the earlier designs and therefore provide the same benefits to overall furnace operations and efficiency.

A key feature of all these burner designs and the jet nozzle design are the high velocity/pressurized jet stream which provides the designer the flexibility of placing the workstock at a greater distance from the heat source than conventional furnaces. Once again, this burner/jet nozzle design can be placed on the top, bottom or sides and/or any combination of the three to the workstock. The furnace can be horizontal, vertical or triangular in configuration. These features enhance overall energy efficiency and provide flexibility in retrofitting. The high velocity/pressurized products of combustion creates a turbulent flow directed towards the workstock, resulting in very uniformand efficient heating of the workstock.

Generally, the burners and jet nozzles can be set 2–12 inches apart from each other and operate at pressures between 1–15 psig. The jet nozzles in such configuration are about 1/16 inch to 1 inch in diameter, cylindrical or tapped. Further, the surface burners can be rectangular or triangular and arranged in a pattern, depending on the size and shape of the metal stock, such that the emanating high pressure/velocity flame can be directed onto the metal stock, thereby maximizing the transfer of thermal energy. Additionally, the firing rate can be varied in the ratio of 10:1 thereby making the apparatus more flexible and more energy efficient over a wider range of production rates and variations.

FIG. 9 is a schematic view showing a trolley system 194 useful in moving the burner assemblies 122, 222 and 322, especially as shown with reference to the burner system 322. It is to be understood that the moving system could be used to advantage with any of the burner assemblies.

Figure 11:
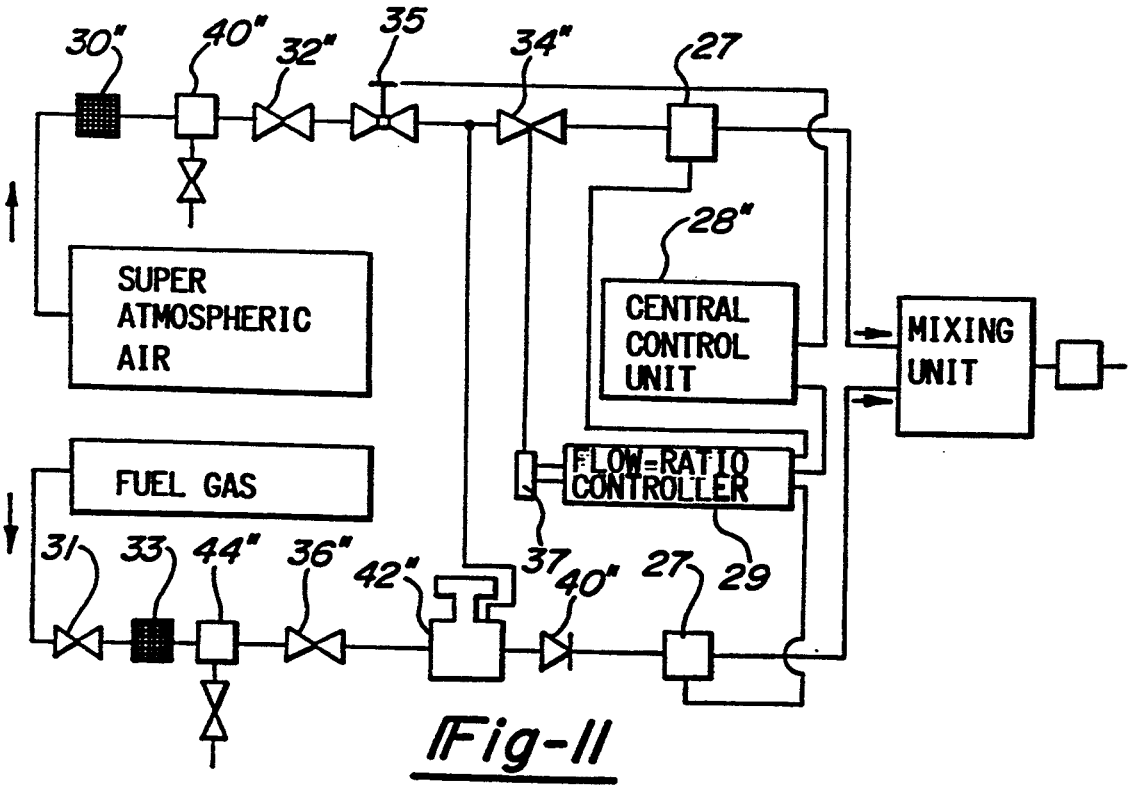
FIG. 11 is a schematic flow diagram of another alternate embodiment of a system for supplying a combustible gas mixture to the burner system using pressurized air and fuel gas.

FIGS. 10 and 11 are schematic views of alternate preferred embodiments of control systems for controlling the supply of air and gaseous fuel to the combustion burners assemblies. In the description of these systems of FIGS. 10 and 11, respectively, primes (') and double primes (") will be used with the numbers when the part is equivalent to a component as described in connection with the control system of FIG. 1.

In the control system of FIG. 10, the air and fuel gas each has its own separate compressor subsystem. Air supply flows through a filter 30' that is the size and type which is needed for the apparatus. This will depend on a number of parameters such as the furnace capacity and the compressor's performance. The air exits the filter and proceeds through a check valve 40' which is used as a safety device. This will close the supply of air to the remainder of the system if insufficient pressure exist to open the valve. Pressure loss, compressor failure or a number of other occurrences could cause the valve not to open and thereby starve the combustion process of required air. The air supply passes through the check valve to the suction side 14*a'* of a compressor 14' where the air is compressed and exited through the outlet 14*b'*. A bypass/delivery system 16', including a control valve, is provided whereby a portion of the exiting compressed air can be recirculated back to the suction side of the compressor. The volume of air recirculated through the bypass subsystem is controlled by the control valve, which in turn is controlled by the central control unit 28' and a fuel gas pressure governor 38'. The bypass subsystem ensures that the proper amounts of compressed air is supplied to the burner assemblies for clean efficient combustion, to support the furnace firing rate, and ensure smooth non-pulsating combustion. The super atmospheric air exiting the compressor travels through an oil trap 44' prior to entering a mixing unit. This oil trap is similar to the one described in FIG. 1 and serves the same purpose.

Fuel gas flows through an isolating valve 36', which provides for a manual shut off of the gas supply. This could be for maintenance or emergency reasons. From isolating valve 36' the gas goes through the pressure governor 38' which regulates the volumetric flow of gaseous fuel and air at the required pressure. A second safety check valve 40' is located prior to the suction side 14*a'* of the compressor 14' provided for the fuel gas and an oil trap 44' is located downstream of the outlet side of the compressor. This second check valve will cut off the fuel supply if there is insufficient pressure to open the valve. The compressor and its re-circulating bypass-/delivery system 16', and oil trap 44' are all similar and provide the same functions as the components described in the single compressor air supply system of FIG. 1.

FIG. 11 describes an arrangement wherein an air supply is available in sufficient quantity and at the required or at a higher pressure. The control system shown includes a throughput air flow control regulator 35 and fuel gas pressure governor 42". The regulator 35 would provide the air at the required pressure and would work in tandem with the gas pressure governor 42" while a control valve 34" would control the flow based on the input from the central control unit 28". A flow control meter 27 is disposed in each of the air and fuel lines and operatively connected to a flow ratio controller 29, to which controller 29 is operatively connected to control unit 28". An actuator 37 sends a signal to control valve 34" to adjust the air volume as needed.

Further, if the fuel gas is available in sufficient quantity and at the required pressure or above it, the subsystem will comprise a regulator, a pressure governor and a control valve. These components work in the same fashion and perform the same functions as described earlier.

Figure 12:
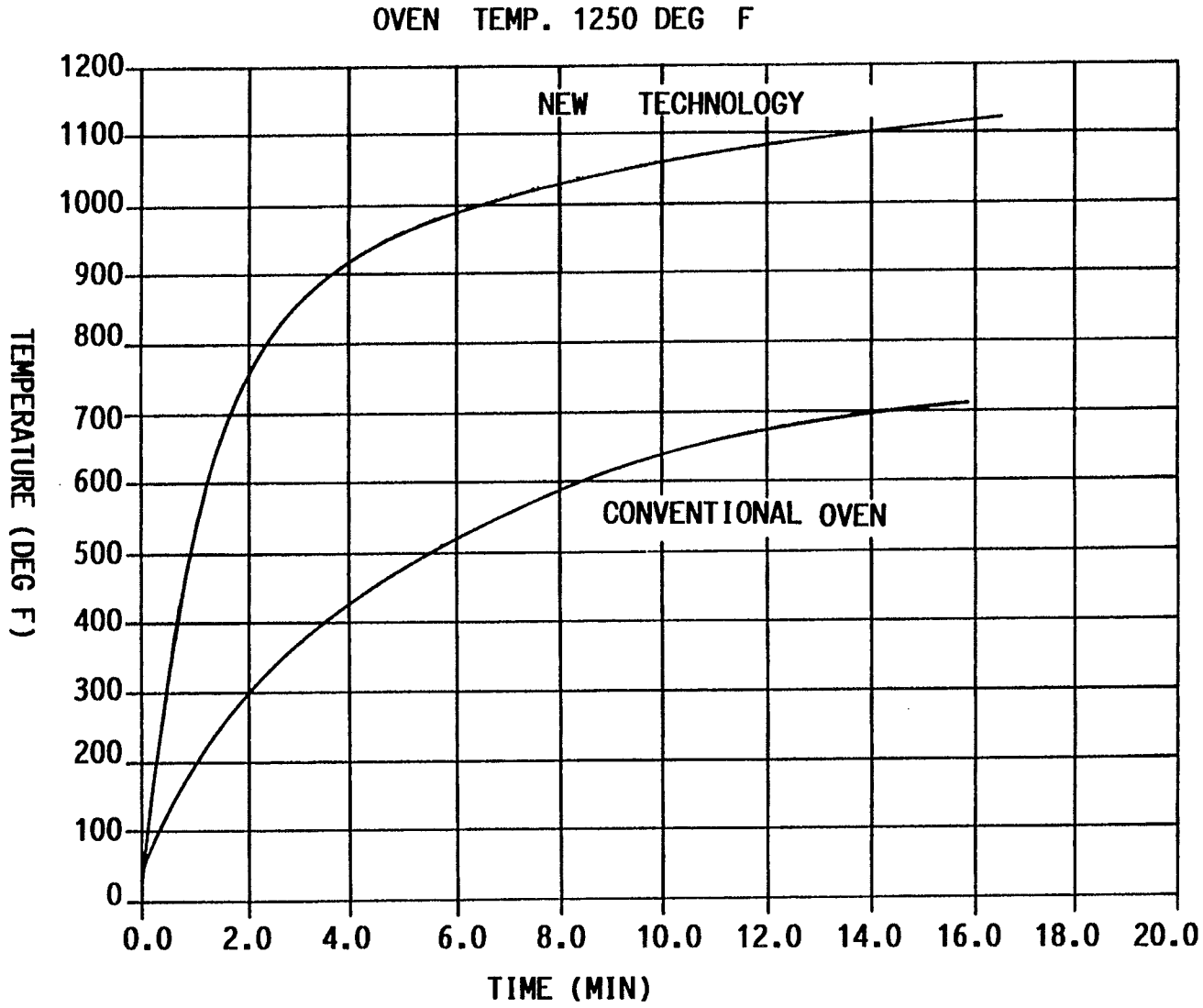
FIG. 12 is a time versus temperature graph of the heating of workpieces during furnace operation utilizing the burner system shown in FIG. 7.
Figure 13:
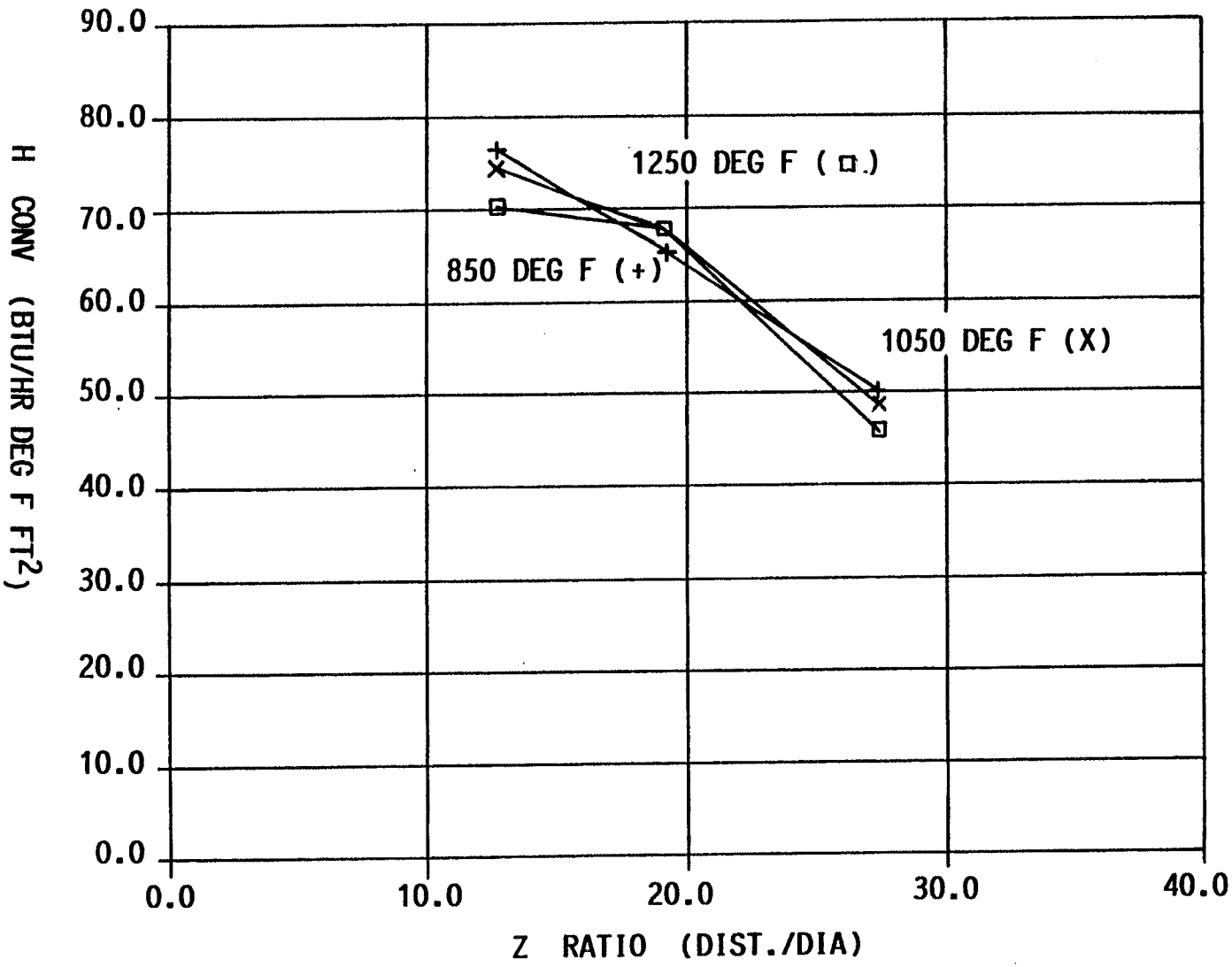
FIG. 13 is a graph illustrating various furnace temperatures as relates to heat convection and a design parameter, utilizing the burner system shown in FIG. 7.

FIGS. 12 and 13 are graphs of actual laboratory data generated on a zone controlled furnace similar to that shown in FIG. 1 and utilizing the burner assembly 322 (see FIGS. 7 and 8). A key feature of this invention is the system's very high convective heat transfer rate and ability to heat the stock faster.

FIG. 12 is a graph comparing a furnace according to this invention, preheated to about 1250° F., with a conventional jet impingement furnace. The abscissa plots time, starting at zero minutes and representing the start of the test, and continues through time (t), when the test was considered complete. The ordinate plots the temperature measured by using a K-type thermocouple embedded into a nine inch square piece of mild steel. The graph depicts the time temperature function of the two designs and clearly demonstrates the faster heating characteristic and overall efficiency advantage of this invention.

FIG. 13 is a graph of actual laboratory data generated on a zone controlled furnace similar to that shown in FIG. 1 and utilizing the burner assembly 322 (see FIGS. 7 and 8). A key feature of this invention is the very high convective heat transfer coefficient generated by this apparatus. The abscissa plots a conventional dimensionless design parameter (i.e., the Z-ratio) and the ordinate plots a convective heat transfer coefficient. Data for three different furnace operating temperatures are shown (viz., 850° F., 1250° F. and 1050° F.). Generally, a convective heat transfer coefficient of 6 to 15 Btu/hr $ft^2$ °F. is used in reference to conventional technology. As seen in this graph, this invention has generated convective heat transfer coefficients as high as 75 Btu/hr $ft^2$ °F.

The zone controlled heating and heat treating furnace and burner assemblies described herein operate to optimize overall efficiency, productivity, and product quality. Precise time-temperature requirements are needed in polymer and chemical coating, and in drying and curing applications. Precise time temperature control, is achieved by the combination of a pressurized surface combustion burner and/or jet nozzles at super atmospheric pressure, with the cooling capability of this apparatus. The ability of a system to deliver varied amounts of thermal energy of higher heat transfer rates towards the workpieces results in higher quality and overall improved efficiency.

The control unit and gas supply system can operate to modulate the heating rate and temperature. For example, the furnace could generate products of combustion at temperatures as low as 300° F. This is especially useful in applications where desired product quality characteristics are directly related to heating rate and temperature. Illustrative are applications such as curing and drying of thermally labile coatings and materials having a very small or limited operating temperature range. This feature can also be used in the event of line slow down or stoppage of a continuous heat treating process thereby to maintain product quality.

While the above description constitutes the preferred embodiment of the invention, it will be appreciated that the invention is susceptible to modification, variation, and change without departing from the proper scope or fair meaning of the accompanying claims.

We claim:

1. A clean burning gas flame heating apparatus for heat treating metal stock, said apparatus comprising:
- a furnace having a heating chamber;
- a plurality of burner assemblies disposed adjacent to said heating chamber for combusting a pressurized fuel gas and air mixture for providing heat to said heating chamber, said pressurized fuel gas and air mixture being selectively supplied to each of said plurality of burner assemblies at a specified pressure;
- means for supplying air to said plurality of burner assemblies;
- means for supplying fuel gas to said plurality of burner assemblies;
- a mixing unit for said air and said fuel gas, said mixing unit operable to create a fuel gas and air premixture, said mixing unit disposed between said plurality of burner assemblies and said air and fuel gas supply means;
- means for compressing said fuel gas and air premixture to provide said pressurized fuel gas and air mixture, said compressing means disposed between said mixing unit and said plurality of burner assemblies;
- means for exhausting the products of said combustion, said exhausting means mated with said heating chamber; and
- means for selectively controlling the supply of said pressurized fuel gas and air mixture to each of said plurality of burner assemblies.

2. The clean burning gas flame heating apparatus of claim 1 wherein said means for supplying air comprises:
- an isolating valve operable to shut off said air supply to said mixing unit; and
- a control valve engaged with both said isolating valve and said mixing unit, said control valve being in communication with said controlling means and operable to vary the flow rate of said air available to said mixing unit.

3. The clean burning gas flame heating apparatus of claim 1 wherein said means for supplying fuel gas comprises:
- an isolating valve operable to shut off said fuel gas supply to said mixing unit;
- a governor engaged with said isolating valve and operable to adjust the pressure of said fuel gas available to said mixing unit;
- a check valve engaged with said governor and operable to allow the flow of said fuel gas in one direction only; and
- a control valve engaged with both said check valve and said mixing unit, said control valve being in communication with said controlling means and operable to vary the flow rate of said fuel gas available to said mixing unit.

4. The clean burning gas flame heating apparatus of claim 1 wherein said compressing means comprises:
- a compressor engaged with the outlet of said mixing unit, said compressor having an input side and a pressure side;
- a feed back line engaged with said compressor for returning a portion of said pressurized fuel gas and air mixture from said pressure side of said compressor to said input side of said compressor; and
- a governor engaged with said feed back line and in communication with said control means for varying the amount of pressurized fuel gas and air mixture delivered to said plurality of burner assemblies.

5. The clean burning gas flame heating apparatus of claim 1 wherein each of said plurality of burner assemblies comprises:
- a plenum in communication with said compressing means for receiving said pressurized fuel gas and air mixture;
- at least one surface combustion burner disposed between said plenum and said heating chamber; and
- means for igniting said pressurized fuel gas and air mixture.

6. The clean burning gas flame heating apparatus of claim 1 wherein each of said plurality of burner assemblies comprises:
- a plenum in communication with said compressing means for receiving said pressurized fuel gas and air mixture;
- at least one jet nozzle burner disposed between said plenum and said heating chamber; and
- means for igniting said pressurized fuel gas and air mixture.

7. The clean burning gas flame heating apparatus of claim 1 wherein each of said plurality of burner assemblies comprises:
- a combustion chamber in communication with said compressing means for receiving said pressurized fuel gas and air mixture;
- means for igniting said pressurized fuel gas and air mixture within said combustion chamber;
- at least one plenum disposed between said combustion chamber and said heating chamber; and
- means for controlling the flow of the products of combustion between said combustion chamber and each of said plenums.

8. The clean burning gas flame heating apparatus of claim 1 wherein said plurality of burner assemblies operate with a pressurized fuel gas and air mixture pressure between one and fifteen PSIG.

9. The clean burning gas flame heating apparatus of claim 1 wherein said exhausting means includes an external heat recovery system for removal of residual heat energy.

10. The clean burning gas flame heating apparatus of claim 1 wherein said exhausting means includes a cyclone/fine particle separator.

11. The clean burning gas flame heating apparatus of claim 1 wherein said plurality of burner assemblies direct the products of combustion towards said metal stock.

12. A clean burning gas flame heating apparatus for heat treating metal stock, said apparatus comprising:
- a furnace having a heating chamber;

a plurality of burner assemblies disposed adjacent to said heating chamber for combusting a pressurized fuel gas and air mixture for providing heat to said heating chamber, said pressurized fuel gas and air mixture being selectively supplied to each of said plurality of burner assemblies at a specified pressure;

means for supplying pressurized air to said plurality of burner assemblies;

means for supplying pressurized fuel gas to said plurality of burner assemblies;

a mixing unit for said pressurized air and said pressurized fuel gas, said mixing unit operable to create said pressurized fuel gas and air mixture, said mixing unit disposed between said plurality of burner assemblies and said pressurized air and pressurized fuel gas supply means;

means for exhausting the products of said combustion, said exhausting means mated with said heating chamber; and means for selectively controlling the supply of said pressurized fuel gas and air mixture to each of said plurality of burner assemblies.

13. The clean burning gas flame heating apparatus of claim 12 wherein said means for supplying pressurized air comprises:

an isolating valve operable to shut off said pressurized air supply to said mixing unit; and a control valve engaged with both said isolating valve and said mixing unit, said control valve being in communication with said controlling means and operable to vary the flow rate of said pressurized air available to said mixing unit.

14. The clean burning gas flame heating apparatus of claim 12 wherein said means for supplying pressurized fuel gas comprises:

an isolating valve operable to shut off said pressurized fuel gas supply to said mixing unit;

a governor engaged with said isolating valve and operable to adjust the pressure of said pressurized fuel gas available to said mixing unit;

a check valve engaged with said governor and operable to allow the flow of said pressurized fuel gas in one direction only; and a control valve engaged with both said check valve and said mixing unit, said control valve being in communication with said controlling means and operable to vary the flow rate of said pressurized fuel gas available to said mixing unit.

15. The clean burning gas flame heating apparatus of claim wherein each of said plurality of burner assemblies comprises:

a plenum in communication with said mixing unit for receiving said pressurized fuel gas and air mixture;

at least one surface combustion burner disposed between said plenum and said heating chamber; and means for igniting said pressurized fuel gas and air mixture,

16. The clean burning gas flame heating apparatus of claim 12 wherein each of said plurality of burner assemblies comprises:

a plenum in communication with said mixing unit for receiving said pressurized fuel gas and air mixture;

at least one jet nozzle burner disposed between said plenum and said heating chamber; and means for igniting said pressurized fuel gas and air mixture.

17. The clean burning gas flame heating apparatus of claim 12 wherein each of said plurality of burner assemblies comprises:

a combustion chamber in communication with said mixing unit for receiving said pressurized fuel gas and air mixture;

means for igniting said pressurized fuel gas and air mixture within said combustion chamber;

at least one plenum disposed between said combustion chamber and said heating chamber; and means for controlling the flow of the products of combustion between said combustion chamber and each of said plenums.

18. The clean burning gas flame heating apparatus of claim 12 wherein said plurality of burner assemblies operate with a pressurized fuel gas and air mixture pressure between one and fifteen PSIG.

19. The clean burning gas flame heating apparatus of claim 12 wherein said exhausting means includes an external heat recovery system for removal of residual heat energy.

20. The clean burning gas flame heating apparatus of claim 12 wherein said exhausting means includes a cyclone/fine particle separator.

21. The clean burning gas flame heating apparatus of claim 12 wherein said plurality of burner assemblies direct the products of combustion towards said metal stock.

22. A clean burning gas flame heating apparatus for heat treating metal stock, said apparatus comprising:

a furnace having a heating chamber;

a plurality of burner assemblies disposed adjacent to said heating chamber for combusting a pressurized fuel gas and air mixture for providing heat to said heating chamber, said pressurized fuel gas and air mixture being selectively supplied to each of said plurality of burner assemblies at a specified pressure;

means for supplying air to said plurality of burner assemblies;

means for supplying fuel gas to said plurality of burner assemblies;

means for compressing said air to provide pressurized air, said compressing means disposed between said means for supplying air and said plurality of burner assemblies;

means for compressing said fuel gas to provide pressurized fuel gas, said compressing means disposed between said means for supplying fuel gas and said plurality of burner assemblies;

a mixing unit for said pressurized air and said pressurized fuel gas, said mixing unit operable to create said pressurized fuel gas and air mixture, said mixing unit disposed between said plurality of burner assemblies and said air and fuel gas compressing means;

means for exhausting the products of said combustion, said exhausting means mated with said heating chamber; and means for selectively controlling the supply of said pressurized fuel gas and air mixture to each of said plurality of burner assemblies.

23. The clean burning gas flame heating apparatus of claim 22 wherein said means for supplying fuel gas comprises:

an isolating valve operable to shut off said fuel gas supply to said means for compressing said fuel gas;

a governor engaged with said isolating valve and operable to adjust the pressure of said fuel gas available to said means for compressing said fuel gas; and a check valve engaged with both said governor and said mixing unit and operable to allow the flow of said fuel gas in one direction only.

24. The clean burning gas flame heating apparatus of claim 22 wherein said means for compressing said air comprises:

a compressor engaged with said means for supplying air, said compressor having an input side and a pressurized side;

a feed back line engaged with said compressor for returning a portion of said pressurized air from said pressurized side of said compressor to said input side of said compressor;

a governor engaged with said feed back line and in communication with said controlling means for varying the amount of pressurized air delivered to said mixing unit.

25. The clean burning gas flame heating apparatus of claim 22 wherein said means for compressing said fuel gas comprises:

a compressor engaged with said means for supplying fuel gas, said compressor having an input side and a pressurized side;

a feed back line engaged with said compressor for returning a portion of said pressurized fuel gas from said pressurized side of said compressor to said input side of said compressor;

a governor engaged with said feed back line and in communication with said controlling means for varying the amount of pressurized fuel gas delivered to said mixing unit.

26. The clean burning gas flame heating apparatus of claim 22 wherein each of said plurality of burner assemblies comprises:

a plenum in communication with said mixing unit for receiving said pressurized fuel gas and air mixture;

at least one surface combustion burner disposed between said plenum and said heating chamber; and means for igniting said pressurized fuel gas and air mixture.

27. The clean burning gas flame heating apparatus of claim 22 wherein each of said plurality of burner assemblies comprises:

a plenum in communication with said mixing unit for receiving said pressurized fuel gas and air mixture;

at least one jet nozzle burner disposed between said plenum and said heating chamber; and means for igniting said pressurized fuel gas and air mixture.

28. The clean burning gas flame heating apparatus of claim 22 wherein each of said plurality of burner assemblies comprises:

a combustion chamber in communication with said mixing unit for receiving said pressurized fuel gas and air mixture;

means for igniting said pressurized fuel gas and air mixture within said combustion chamber;

at least one plenum disposed between said combustion chamber and said heating chamber; and means for controlling the flow of the products of combustion between said combustion chamber and each of said plenums.

29. The clean burning gas flame heating apparatus of claim 22 wherein said plurality of burner assemblies operate with a pressurized fuel gas and air mixture pressure between one and fifteen PSIG.

30. The clean burning gas flame heating apparatus of claim 22 wherein said exhausting means includes an external heat recovery system for removal of residual heat energy.

31. The clean burning gas flame heating apparatus of claim 22 wherein said exhausting means includes a cyclone/fine particle separator.

32. The clean burning gas flame heating apparatus of claim 22 wherein said plurality of burner assemblies direct the products of combustion towards said metal stock.

* * * * *

UNITED STATES PATENT AND TRADEMARK OFFICE

CERTIFICATE OF CORRECTION

PATENT NO. : 5,364,080

DATED : Nov. 15, 1994

INVENTOR(S) : William E. Kraemer et al

It is certified that error appears in the above-indentified patent and that said Letters Patent is hereby corrected as shown below:

Col. 1, line 59, "non-uniformheating" should be --non-uniform heating--;

Col. 6, line 24, 2), "forman" should be --form an--;

Col. 7, lines 27-28, "provide" should be --provides--;

Col. 8, line 61, "uniformand" should be --uniform and--;

Col. 9, line 31, "exist" should be --exists--; and

Col. 13, line 52, Claim 15, after "claim" insert --12--.

Signed and Sealed this

Seventh Day of March, 1995

*Attest:*

Bruce Lehman

BRUCE LEHMAN

*Attesting Officer*

*Commissioner of Patents and Trademarks*